US007859511B2

(12) United States Patent
Shen et al.

(10) Patent No.: US 7,859,511 B2
(45) Date of Patent: Dec. 28, 2010

(54) DC-DC CONVERTER WITH TEMPERATURE COMPENSATION CIRCUIT

(75) Inventors: Yuhren Shen, Tainan (TW); Hung-Chi Chu, Kaohsiung (TW); Ming-Chia Wang, Sijhih (TW)

(73) Assignee: Vastview Technology, Inc., Hsin-Chu Hsien (TW)

( * ) Notice: Subject to any disclaimer, the term of this patent is extended or adjusted under 35 U.S.C. 154(b) by 782 days.

(21) Appl. No.: 11/822,574

(22) Filed: Jul. 9, 2007

(65) Prior Publication Data

US 2008/0309608 A1 Dec. 18, 2008

(30) Foreign Application Priority Data

Jun. 12, 2007 (TW) ..... 96121231 A

(51) Int. Cl.
*G09G 3/36* (2006.01)

(52) U.S. Cl. ..... 345/101; 345/214; 348/602

(58) Field of Classification Search ..... 345/101, 345/214; 348/602; 323/285
See application file for complete search history.

(56) References Cited

U.S. PATENT DOCUMENTS 7,038,654 B2 * 5/2006 Naiki et al. ..... 345/101
7,327,129 B2 * 2/2008 Chen et al. ..... 323/285
2005/0184946 A1 * 8/2005 Pyoun et al. ..... 345/94

* cited by examiner

*Primary Examiner*—Chanh Nguyen
*Assistant Examiner*—Kwang-Su Yang
(74) *Attorney, Agent, or Firm*—Rosenberg, Klein & Lee

(57) ABSTRACT

A DC-DC converter includes a temperature compensation circuit arranged between a feedback differential amplification circuit and an output voltage detection circuit to compensate the variation of the voltage level of the DC output voltage of the converter caused by ambient temperature changes. The temperature compensation circuit includes a temperature detection circuit that detects the ambient temperature and, in response thereto, generates a temperature signal; and a current source circuit that is connected between a feedback signal input terminal of the feedback differential amplification circuit and the output voltage detection circuit. The current source circuit, based on the temperature signal, generates an electrical current and a compensation voltage proportional to the electrical current. The compensation voltage is applied to the DC output voltage to thereby regulate the voltage level of the DC output voltage. The temperature signal is a temperature signal of positive temperature characteristics and/or a temperature signal of negative temperature characteristics.

11 Claims, 7 Drawing Sheets

DC-DC CONVERTER WITH TEMPERATURE COMPENSATION CIRCUIT

FIELD OF THE INVENTION

The present invention relates generally to a DC-DC converter, and in particular to a DC-DC converter with a temperature compensation circuit, which is particularly suitable for serving as a power supply circuit for a liquid crystal display.

BACKGROUND OF THE INVENTION

In a lot of electronic devices, a DC-DC converter circuit is required for supply of a stable rated working voltage. The DC-DC converter circuit has a generally construction that comprises a transistor based switching unit, which generally adopts a metal oxide semiconductor (MOS) field effect transistor (FET), a comparator, a saw-tooth wave generation circuit, an output voltage detection circuit, a feedback differential amplification circuit, and a reference voltage signal generation circuit. The operation of the DC-DC converter is that the output voltage detection circuit detects the voltage level of a DC output voltage and, in response thereto, generates a feedback signal that is fed through the feedback differential amplification circuit and the comparator to provide a gate control signal that controls the ON/OFF state of the transistor based switching unit in order to generate a stable DC output voltage at a voltage output terminal. Such a DC-DC converter has been commonly adopted in power supply circuits for liquid crystal display devices.

FIG. 1 of the attached drawings illustrates a circuit block diagram of a conventional power supply circuit for a liquid crystal display. The liquid crystal display, which is generally designated at 100, comprises a liquid crystal display panel 1, a gate driver 11, a data driver 12, and a logic control unit 13. These components/devices are operated with different working voltages. For a classic liquid crystal display 100, various working voltages of different levels are needed, including at least four different voltage levels, such as a gate switching-on voltage VGH, a gate switching-off voltage VGL, a data driving voltage VDD, a control logic circuit voltage Vlogic. All these working voltages are provided by a direct current supply circuit 200 and all these working voltages have different rated values. For example, the data driving voltage VDD is a working voltage of high voltage level and is provided by a boost-typed DC-DC converter.

Considering the DC-DC converter that provides the data driving voltage VDD as an example, as shown in FIG. 2, the DC-DC converter, which is generally designated with reference numeral 2, is supplied with a DC input voltage Vin flowing through a voltage supply circuit loop 201 consisting of an inductor element L and a forward-connected diode D and generates a DC output voltage Vout at a voltage output terminal N2. The voltage output terminal N2 is normally connected with a capacitor C serving as a filter.

The DC-DC converter 2 comprises a transistor based switching unit 21, which is a switching circuit composed of a MOS FET or power transistors of other types. The transistor based switching unit 21 has a drain that is connected to a node N1 between the inductor element L and the diode D, and a source that is electrically grounded. The transistor based switching unit 21 also has a gate that is electrically connected to a gate driver circuit 22.

A comparator 23 has a saw-tooth wave signal input terminal 23*a*, a differential signal input terminal 23*b*, and an output terminal 23*c*. The saw-tooth wave signal input terminal 23*a* receives a saw-tooth wave signal Vs from a saw-tooth wave signal generation circuit 24. The output terminal 23*c* of the comparator 23 is electrically connected to the gate driver circuit 22 to provide a gate control signal Vp to the gate driver circuit 22.

An output voltage detection circuit 25 is electrically connected to the voltage output terminal N2 to detect the voltage level of the DC output voltage Vout at the voltage output terminal N2, and in response thereto, generates a feedback signal Vfeb. The output voltage detection circuit 25 is composed of a first resistor R1 and a second resistor R2 that are connected in series to constitute a voltage divider circuit. A feedback node N3 between the first resistor R1 and the second resistor R2 provides a divided voltage signal, serving as the feedback signal Vfeb.

A feedback differential amplification circuit 26 has a feedback signal input terminal 26*a*, a reference voltage input terminal 26*b*, a differential signal output terminal 26*c*. The feedback signal input terminal 26*a* receives the feedback signal Vfeb from the output voltage detection circuit 25. The reference voltage input terminal 26*b* receives a reference voltage Vref generated by a reference voltage signal generation circuit 27. The differential signal output terminal 26*c* is electrically connected to the differential signal input terminal 23*b* of the comparator 23. Based on the feedback signal Vfeb and the reference voltage Vref received, the feedback differential amplification circuit 26 generates and feeds an error signal Verr through the differential signal output terminal 26*c* thereof to the differential signal input terminal 23*b* of the comparator 23. With such a DC-DC converter constituted by the above arrangement of the components/circuits/devices, a stable output voltage Vout can be obtained at the voltage output terminal N2 and the output voltage Vout is determined from the following equation: Vout=(1+R1/R2)Vref.

In some applications, such a conventional arrangement of the DC-DC converter works perfectly to supply the required rated voltage output for ordinary electronic devices. However, the known circuit of the conventional DC-DC converter is not satisfactory in view of the requirements for high precision, high environment durability, high stability, and low temperature drafting.

This is particularly true for liquid crystal displays. This is simply because the characteristics of a liquid crystal display are often affected by temperature change at the display panel of the liquid crystal display as well as the change of ambient temperature. For example, when the ambient temperature rises, the phase difference of the liquid crystal display panel is reduced and electric charges on the liquid crystal display panel are increased, leading to overcharging. This phenomenon influences the optic characteristics of the liquid crystal display panel, including the brightness, transmission, and gamma curve.

To overcome such a problem, conventionally, the data driving voltage VDD is increased, or the gate switching-on voltage VGH is reduced or lowered. This solution cannot effectively counteract the influence to the liquid crystal display panel caused by temperature changes. Further, this conventional technique cannot realize the temperature compensation operations of positive temperature coefficient or negative temperature coefficient according to the temperature changes by means of signal switching.

Various temperature compensation techniques are available in prior patent references. For example, US Patent Publication No. 2007/0085803A1 discloses a temperature compensation circuit for a liquid crystal display, wherein the temperature compensation circuit is realized by an operational amplifier, together with associated resistors and capacitors, which circuit is connected in series to a front stage of a common circuit for both a gate switching-on voltage (VGH) and a data driving voltage (VDD) of a liquid crystal display. This arrangement provides an effect of temperature compensation to certain extents, yet it is operated with a comparator that performs simple comparison between signals wherein the comparator compares the voltage levels of a detected ambient temperature and a data driving voltage (VDD) to generate a compensation voltage that is applied to a gate switching-on voltage supply circuit and a data driving voltage supply circuit. The regulation of the output voltage in this way is not precise. Further, the voltage regulation operation is concurrently carried out on both the gate switching-on voltage (VGH) and the data driving voltage (VDD) of the liquid crystal display without taking into consideration the different requirements existing between the gate switching-on voltage and the data driving voltage. Consequently, this solution is impractical in actual applications.

Another example is illustrated in U.S. Pat. No. 7,038,654, which also discloses a temperature compensation circuit for a liquid crystal display, which supplies a temperature signal obtained with a temperature sensor to a driver controller. The driver controller in turn provides a control signal that controls a reference voltage of an amplifier, and this, together with a step-up circuit, effects the regulation of an output voltage. This technique, although workable for temperature compensation, requires the change or adjustment of reference voltage and employment of digital technique to ensure realization of temperature compensation. This is not easy for practicing.

A further example is U.S. Pat. No. 6,803,899, which also discloses a temperature compensation circuit for a liquid crystal display, wherein a temperature signal obtained with a temperature sensor is used to regulate the voltage output with digital control technique, together with pulse width control technique. This solution also relies on digital control technique to realize temperature compensation and is thus difficult to practice.

SUMMARY OF THE INVENTION

In view of the above discussed problems associated with the conventional temperature compensation techniques for DC-DC converters, an objective of the present invention is to provide a DC-DC converter that uses the operation of current supplies to realize temperature compensation circuit and regulates voltage level of an output voltage in response to environmental temperature change by means of the temperature compensation circuit.

Another objective of the present invention is to provide a DC-DC converter that is particularly suitable for the supply of working voltages for a liquid crystal display, wherein the DC-DC converter includes a temperature compensation circuit that is incorporated in a voltage supply circuit loop of a liquid crystal display to supply the desired working voltage for the liquid crystal display.

To fulfill the above objects, the present invention provides a DC-DC converter. The DC-DC converter includes a temperature compensation circuit arranged between a feedback differential amplification circuit and an output voltage detection circuit to compensate the variation of the voltage level of the DC output voltage of the DC-DC converter caused by the ambient temperature changes. The temperature compensation circuit includes a temperature detection circuit that detects the ambient temperature and generates a temperature signal; and a current source circuit that is connected between a feedback signal input terminal of the feedback differential amplification circuit and the output voltage detection circuit. The current source circuit, based on the temperature signal, generates an electrical current and a compensation voltage proportional to the electrical current. The compensation voltage is applied to the DC output voltage to thereby regulate the voltage level of the DC output voltage. The temperature signal is a temperature signal of positive temperature characteristics and/or a temperature signal of negative temperature characteristics.

As compared to the known techniques, the present invention provides a DC-DC converter that combines current supply components/devices to realize temperature compensation so that the DC-DC converter can effectively supply regulated working voltage in response to ambient temperature changes. The DC-DC converter of the present invention is applicable to a liquid crystal display with the temperature compensation circuit incorporated in a voltage supply circuit loop of the liquid crystal display, whereby the liquid crystal of the liquid crystal display is supplied with proper working voltage at various temperatures and thus maintains stable characteristics.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
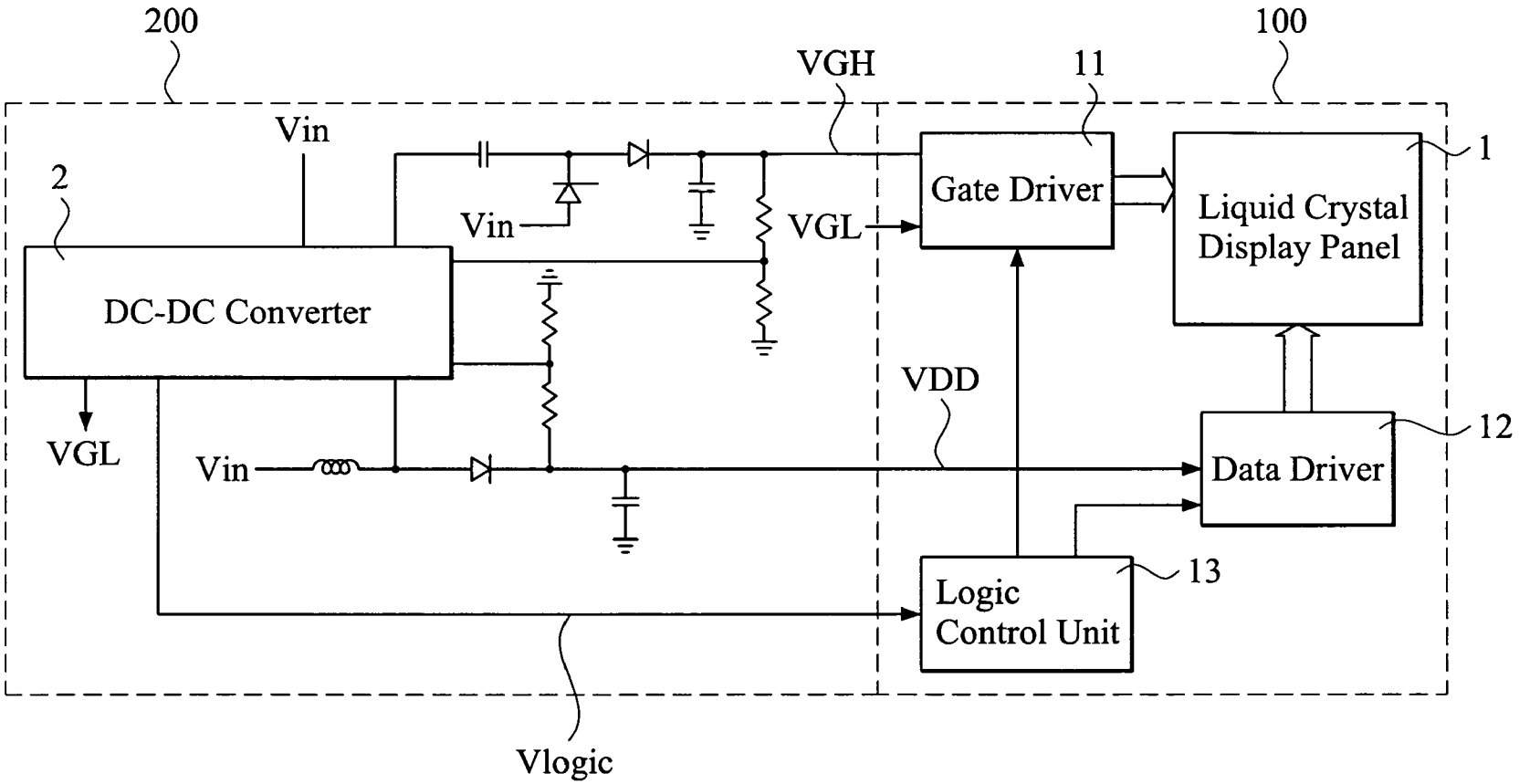
FIG.1(Prior Art)
FIG. 1 is a function block diagram of a conventional power supply circuit for a liquid crystal display.
Figure 2:
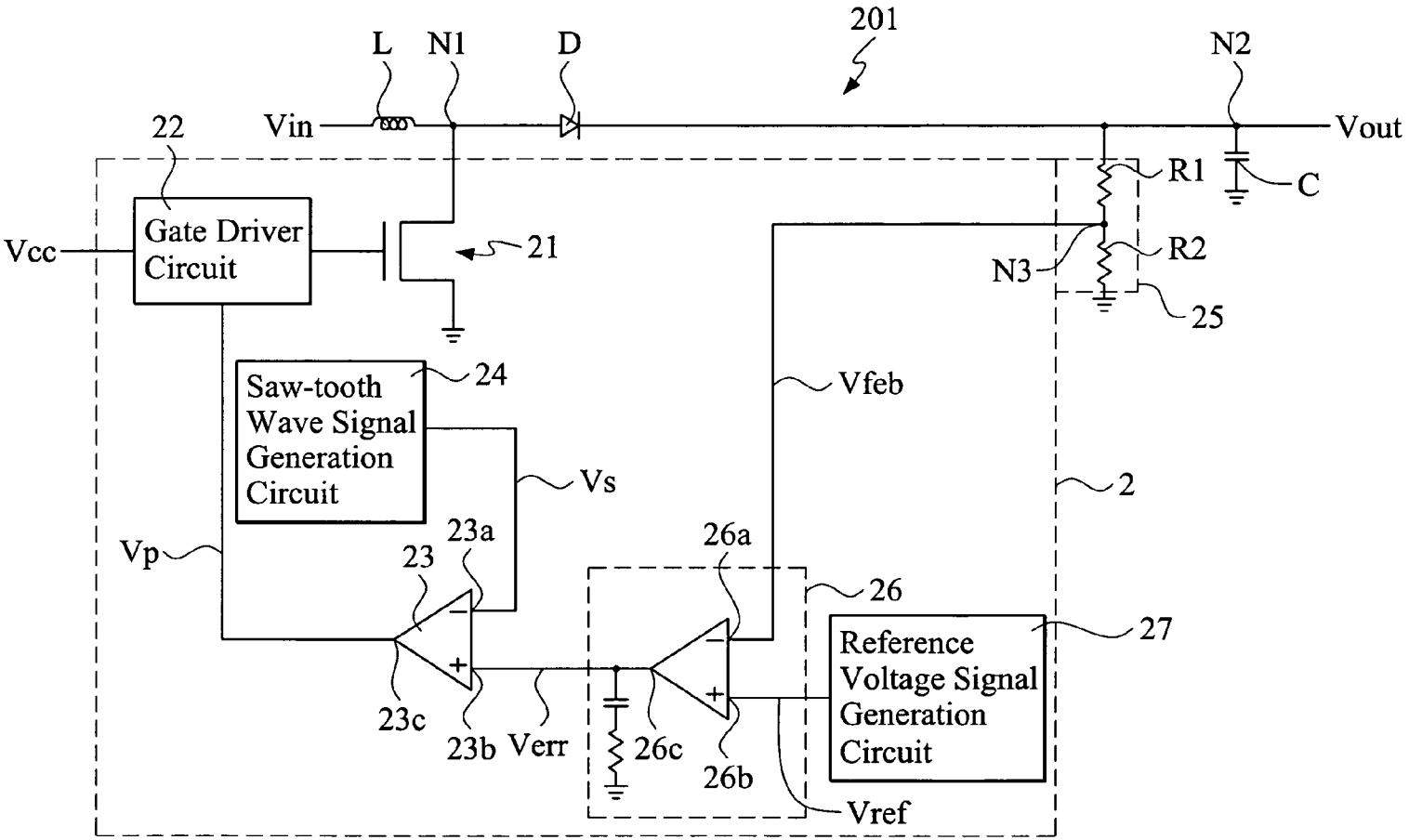
FIG.2(Prior Art)
FIG. 2 is a circuit diagram of a conventional DC-DC converter.
Figure 3:
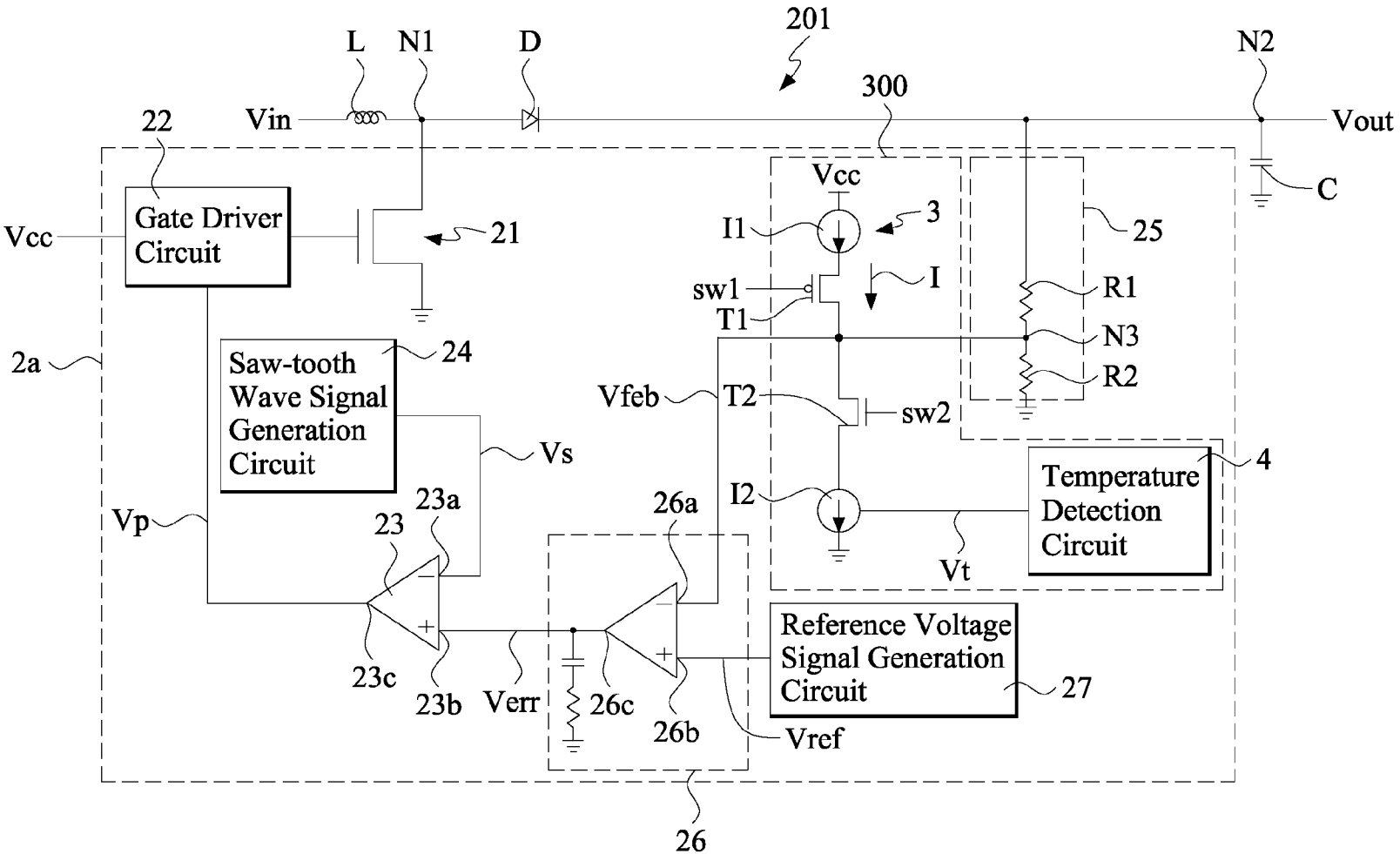
FIG. 3 is a circuit diagram of a DC-DC converter constructed in accordance with the present invention.

With reference to the drawings and in particular to FIG. 3, a circuit diagram of a DC-DC converter constructed in accordance with the present invention is shown. To simplify the description and to provide a cross reference and comparison between the DC-DC converter of the present invention and a conventional converter, parts/devices/elements used in the DC-DC converter of the present invention that are the same as those counterparts of the conventional converter will bear the same references as discussed previously in the BACK- GROUND section. It is also noted that a DC-DC converter configured for providing a data driving voltage of a liquid crystal display is taken as an example for explanation of the present invention in the following description.

The DC-DC converter in accordance with the present invention, generally designated with reference numeral 2*a*, comprises a transistor based switching unit 21 having a drain terminal connected to a node N1 between an inductor element L and a diode D of a voltage supply circuit loop 201 and a source terminal that is electrically grounded. The transistor based switching unit 21 also has a gate terminal that is electrically connected to a gate driver circuit 22.

A comparator 23 has a saw-tooth wave signal input terminal 23*a*, a differential signal input terminal 23*b*, and an output terminal 23*c*. The saw-tooth wave signal input terminal 23*a* receives a saw-tooth wave signal Vs from a saw-tooth wave signal generation circuit 24. The output terminal 23*c* of the comparator 23 is electrically connected to the gate driver circuit 22.

An output voltage detection circuit 25 is electrically connected to a voltage output terminal N2 to detect the voltage level of the DC output voltage Vout provided at the voltage output terminal N2, and in response thereto, generates a feedback signal Vfeb. The output voltage detection circuit 25 is composed of a first resistor R1 and a second resistor R2 that are connected in series to constitute a voltage divider circuit. A feedback node N3 between the first resistor R1 and the second resistor R2 provides a divided voltage signal, serving as the feedback signal Vfeb.

A feedback differential amplification circuit 26 has a feedback signal input terminal 26*a*, a reference voltage input terminal 26*b*, a differential signal output terminal 26*c*. The feedback signal input terminal 26*a* receives the feedback signal Vfeb from the output voltage detection circuit 25. The reference voltage input terminal 26*b* receives a reference voltage Vref generated by a reference voltage signal generation circuit 27. The differential signal output terminal 26*c* is electrically connected to the differential signal input terminal 23*b* of the comparator 23. Based on the feedback signal Vfeb and the reference voltage Vref received, the feedback differential amplification circuit 26 generates and feeds an error signal Verr through the differential signal output terminal 26*c* thereof to the differential signal input terminal 23*b* of the comparator 23.

In accordance with the present invention, the DC-DC converter further comprises a temperature compensation circuit 300, which is electrically connected between the feedback signal input terminal 26*a* of the feedback differential amplification circuit 26 and the output voltage detection circuit 25. The temperature compensation circuit 300 comprises a current source circuit 3 and a temperature detection circuit 4. The temperature detection circuit 4, in response to a detected ambient temperature signal, generates a voltage-type temperature signal Vt that is fed to the current source circuit 3. The current source circuit 3, based on the temperature signal Vt from the temperature detection circuit 4, generates a corresponding electrical current I and also generates a compensation voltage IR1 that is proportional to the current I and that is applied to (either added to or subtracted from) the DC output voltage Vout. In other words, the DC output voltage Vout is determined by the following equation: Vout=(1+R1/R2)Vref±IR1. In this way, the voltage level or voltage value of the DC output voltage Vout can be adjusted or regulated.

In the circuit shown in FIG. 3, the current source circuit 3 comprises a first current source I1, a first switch T1, a second current source I2, and a second switch T2. The first current source I1 and the first switch T1 are connected in series between a power supply Vcc and the feedback node N3 between the first resistor R1 and the second resistor R2 of the output voltage detection circuit 25. The ON/OFF state of the first switch T1 is controlled by a first switching signal sw1.

The second current source I2 and the second switch T2 are connected in series between the feedback node N3 between the first resistor R1 and the second resistor R2 of the output voltage detection circuit 25 and grounding. The ON/OFF state of the second switch T2 is controlled by a second switching signal sw2.

The current source circuit 3 supplies an electrical current I. The following possible cases are available:

(1) When the first switching signal sw1 is low (the first switch T1 being set ON) and the second switching signal sw2 is also low (the second switch T2 being set OFF), the DC output voltage Vout at the voltage output terminal N2 is determined with the following equation: Vout=(1+R1/R2)Vref−IR1. Thus, a positive temperature coefficient compensation is realized.

(2) When the first switching signal sw1 is high (the first switch T1 being set OFF) and the second switching signal sw2 is also high (the second switch T2 being set ON), the DC output voltage Vout at the voltage output terminal N2 is determined with the following equation: Vout=(1+R1/R2)Vref+IR1. Thus, a negative temperature coefficient compensation is realized.

(3) When the first switching signal sw1 is high (the first switch T1 being set OFF) and the second switching signal sw2 is low (the second switch T2 being set OFF), no temperature coefficient compensation can be effected.

Based on the above available situations, a user may control the first switching signal sw1 and the second switching signal sw2 to selectively enable a positive temperature coefficient compensation or a negative temperature coefficient compensation, or to disable any temperature coefficient compensation.

Figure 4:
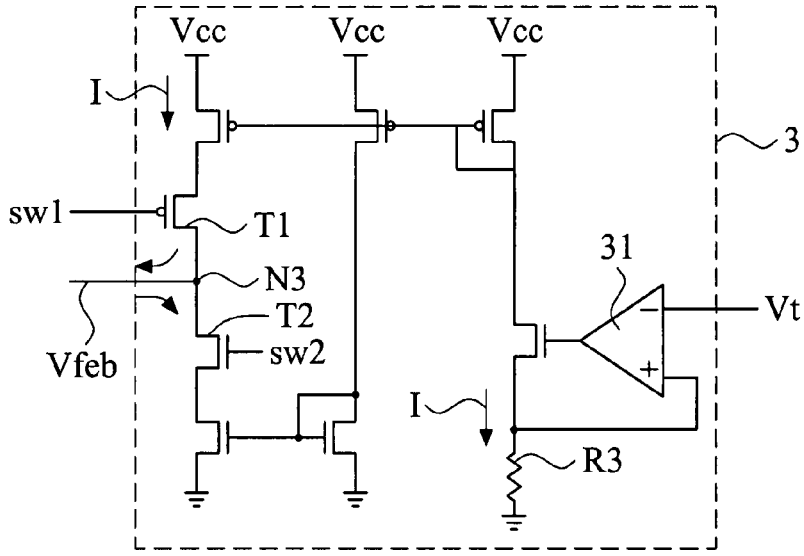
FIG. 4 is a circuit diagram of a current source circuit of the DC-DC converter illustrated in FIG. 3.

FIG. 4 shows an example circuit of the current source circuit 3 of the DC-DC converter illustrated in FIG. 3, which comprises an amplifier 31, a resistor R3, and a current mirror circuit composed of a plurality of transistors. The current I supplied from the current source circuit 3 is determined with the following equation: I=Vt/R3.

The temperature detection circuit 4 can be embodied with a temperature detection device that includes for example a positive temperature coefficient device or a negative temperature coefficient device, or a temperature detection circuit that includes diodes (or Zener diodes) and resistors to effect a positive temperature coefficient or a negative temperature coefficient for realizing positive temperature coefficient compensation or negative temperature coefficient compensation.

Figure 5:
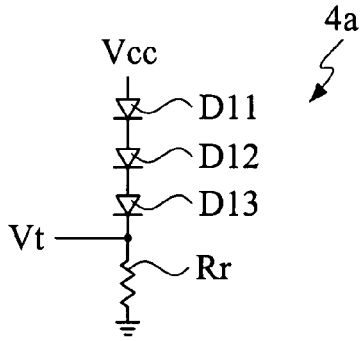
FIG. 5 is a circuit diagram of a temperature detection circuit featuring positive temperature coefficient and constructed with three diodes and a resistor connected in series.
Figure 6:
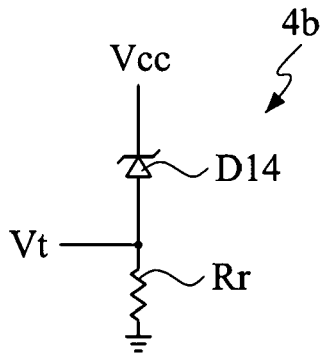
FIG. 6 is a circuit diagram of a temperature detection circuit featuring positive temperature coefficient and constructed with a Zener diode and a resistor connected in series.

An example is given in FIG. 5, wherein three diodes D11, D12, D13 are connected to a resistor Rr in series, and the series connection of the diodes D11, D12, D13 and the resistor Rr is connected between the power supply Vcc and grounding. A temperature signal Vt provided at a node between the diodes D11, D12, D13 and the resistor Rr is of positive temperature coefficient. Thus, a temperature detection circuit 4*a* having characteristics of positive temperature coefficient is obtained. The diodes D11, D12, D13 can be replaced by a single Zener diode D14, as illustrated in FIG. 6, and again, a temperature detection circuit 4*b* having characteristics of positive temperature coefficient can be obtained.

Figure 7:
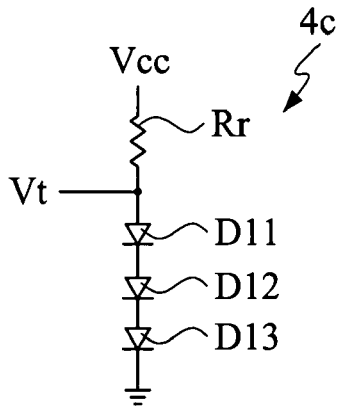
FIG. 7 is a circuit diagram of a temperature detection circuit featuring negative temperature coefficient and constructed with a resistor and three diodes connected in series.
Figure 8:
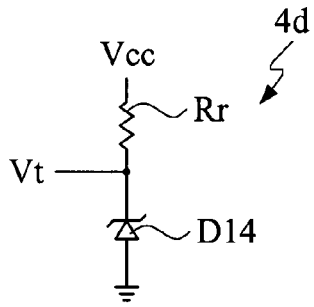
FIG. 8 is a circuit diagram of a temperature detection circuit featuring negative temperature coefficient and constructed with a resistor and a Zener diode connected in series.

For a temperature signal Vt of negative temperature coefficient, as shown in FIG. 7, a resistor Rr is connected in series to three diodes D11, D12, D13, which themselves are connected in series. The series connection of the resistor Rr and the diodes D11, D12, D13 is then connected between the power supply Vcc and the grounding. A temperature signal Vt provided at a node between the resistor Rr and the diodes D11, D12, D13 is of negative temperature coefficient. Thus, a temperature detection circuit 4*c* having characteristics of negative temperature coefficient is obtained. The diodes D11, D12, D13 can be replaced by a single Zener diode D14, as illustrated in FIG. 8, and again, a temperature detection circuit 4*d* having characteristics of negative temperature coefficient can be obtained.

Figure 9:
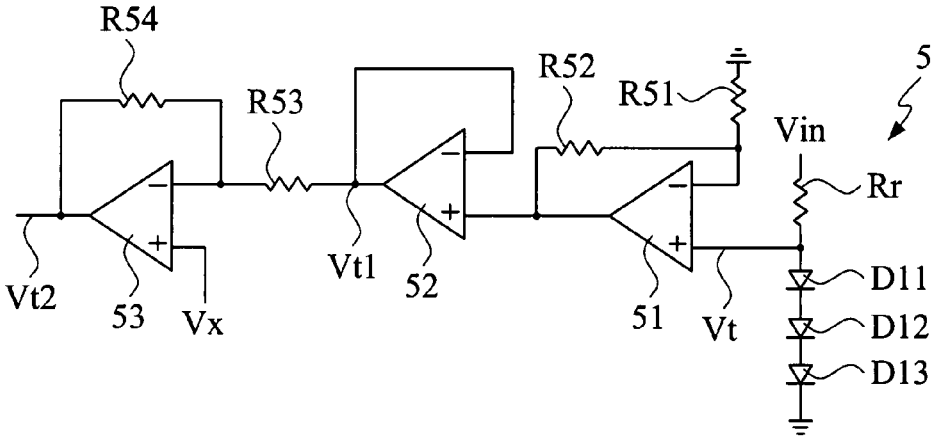
FIG. 9 is a circuit diagram of a temperature detection circuit that provides both a temperature signal of positive temperature coefficient and a temperature signal of negative temperature coefficient.

In accordance with the present invention, a circuit that simultaneously provides a temperature signal of positive temperature coefficient and a temperature signal of negative temperature coefficient is also available. FIG. 9 illustrates such a circuit that provides both a temperature signal of positive temperature coefficient and a temperature signal of negative temperature coefficient and the circuit comprises three operational amplifiers 51, 52, 53 and resistors R51, R52, R53, R54.

As discussed previously, negative temperature coefficient can be obtained with series connection between a resistor Rr and diodes D11, D12, D13 that are connected in series. With the series connection being arranged between an input voltage Vin and grounding, a temperature signal Vt provided at a node between the resistor Rr and the series-connected diodes D11, D12, D13 is of negative temperature coefficient. It is also noted previously that the diodes D11, D12, D13 can be replaced by a Zener diode.

The temperature signal Vt so obtained is fed in sequence through the operational amplifiers 51, 52, 53 and a first temperature signal Vt1 of negative temperature coefficient and a second temperature signal Vt2 of positive temperature coefficient are respectively obtained at the output terminals of the operational amplifiers 52, 53. And the voltage levels or voltage values of the first and second temperature signals Vt1 and Vt2 are determined with the following equations:

$$Vt1=(1+R52/R51)Vt$$

$$Vt2=(1+R54/R53)Vx-(1+R52/R51)(R54/R53)Vt$$

Practical applications of the DC-DC converter with temperature compensation circuit in accordance with the present invention may include all kinds of electronic circuits that need temperature compensation. For example, the DC-DC converter of the present invention is best applicable to a liquid crystal display. The DC output voltage generated by the DC-DC converter of the present invention is applicable to a data driver circuit and a gate driver circuit of the liquid crystal display to serve as data driving voltage VDD and gate switching-on voltage VGH, respectively.

Figure 10:
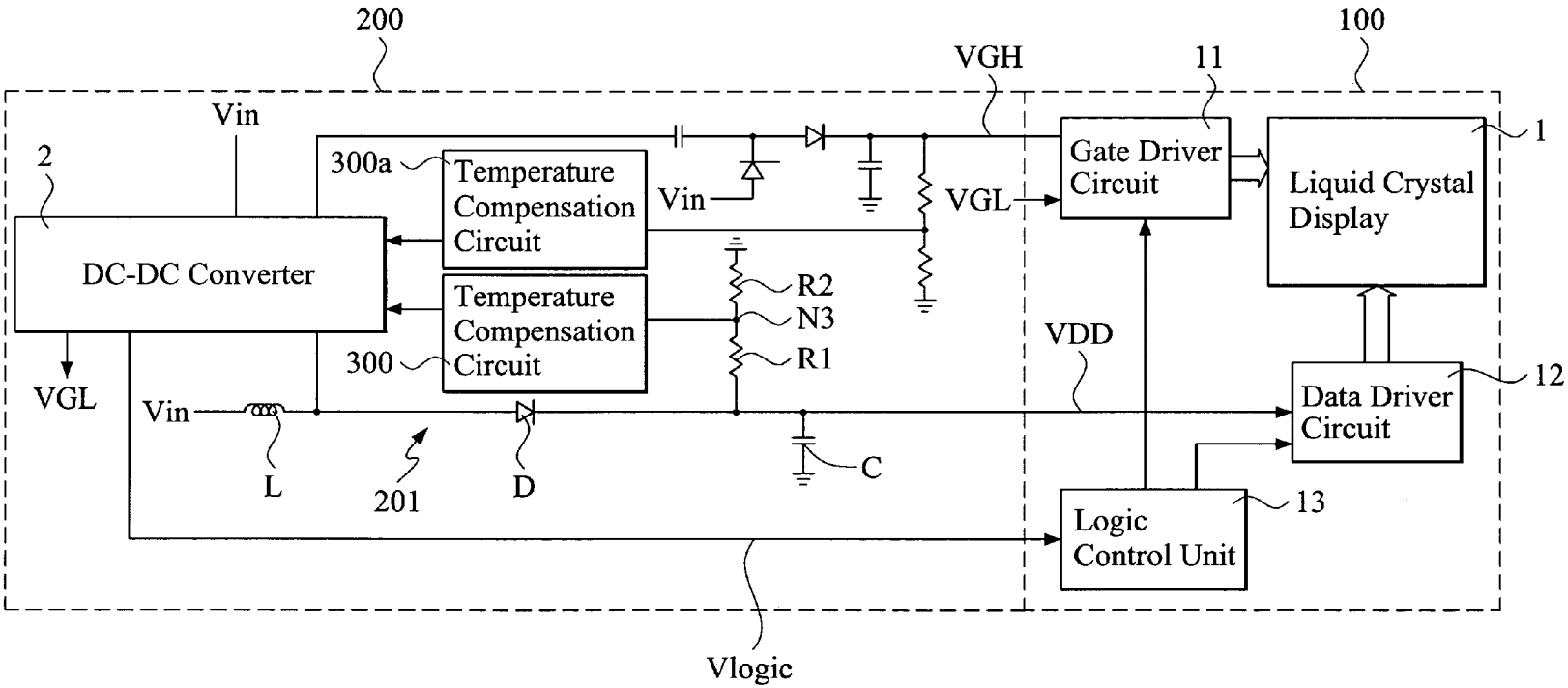
FIG. 10 is a block diagram of a power supply circuit of a liquid crystal display in accordance with the present invention.

Referring to FIG. 10, a circuit diagram in block form of a power supply circuit for a liquid crystal display is illustrated. For a power supply circuit that supplies a data driving voltage VDD to a data driver circuit 12 of a liquid crystal display 100, a temperature compensation circuit 300 is arranged between a feedback node N3 between resistors R1, R2 of a voltage supply circuit loop 201 that provides the data driving voltage VDD and a feedback differential amplification circuit of the DC-DC converter 2 in order to supply a stable data driving voltage VDD. Also, for a power supply circuit that supplies a gate driving voltage VGH to a gate driver circuit 11 of the liquid crystal display 100, a temperature compensation circuit 300*a* is similarly arranged between a feedback node of the voltage supply circuit loop that provides the gate driving voltage VGH and a feedback differential amplification circuit of the DC-DC converter in order to supply a stable gate driving voltage VGH.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A DC-DC converter for converting a DC input voltage and supplying a DC output voltage at a voltage output terminal through a voltage supply circuit loop, the DC-DC converter comprising:

a transistor based switching unit, having a source, a drain, and a gate, the drain being connected to the voltage supply circuit loop, the source being connected to a ground potential;

a comparator, having a saw-tooth wave signal input terminal, a differential signal input terminal, and an output terminal, the saw-tooth wave signal input terminal receiving a saw-tooth wave signal, the output terminal being connected through a gate driver circuit to the gate of the transistor based switching unit;

an output voltage detection circuit, being electrically connected to the voltage supply circuit loop to detect a voltage level of the DC output voltage and generating a feedback signal at a feedback node;

a feedback differential amplification circuit, having a reference voltage input terminal, a feedback signal input terminal, and a differential signal output terminal, the reference voltage input terminal receiving a reference voltage, the feedback signal input terminal receiving the feedback signal from the output voltage detection circuit, the differential signal output terminal being connected to the differential signal input terminal of the comparator; and a temperature compensation circuit connected between the feedback differential amplification circuit and the output voltage detection circuit and comprising:

a temperature detection circuit that detects an ambient temperature and, in response thereto, generates a temperature signal, and a current source circuit connected between the feedback signal input terminal of the feedback differential amplification circuit and the output voltage detection circuit, wherein the current source circuit, based on the temperature signal from the temperature detection circuit, generates an electrical current and generates a compensation voltage proportional to the electrical current, the compensation voltage being applied to the DC output voltage to thereby regulate the voltage level of the DC output voltage.

2. The DC-DC converter as claimed in claim 1, wherein the current source circuit of the temperature compensation circuit is connected between a power supply and the feedback node of the output voltage detection circuit.

3. The DC-DC converter as claimed in claim 1, wherein the current source circuit of the temperature compensation circuit is connected between the feedback node of the output voltage detection circuit and a grounding point.

4. The DC-DC converter as claimed in claim 1, wherein the current source circuit of the temperature compensation circuit comprises:

a first current source;

a first switch connected in series to the first current source, the series connection of the first switch and the first current source being further connected between a power supply and the feedback node of the output voltage detection circuit, the first switch having on/off state controlled by a first switching signal;

a second current source; and a second switch connected in series to the second current source, the series connection of the second switch and the second current source being further connected between the feedback node of the output voltage detection circuit and a grounding point, the second switch having on/off state controlled by a second switching signal.

5. The DC-DC converter as claimed in claim 1, wherein the temperature signal generated by the temperature detection circuit comprises a temperature signal of positive temperature characteristics.

6. The DC-DC converter as claimed in claim 1, wherein the temperature signal generated by the temperature detection circuit comprises a temperature signal of negative temperature characteristics.

7. The DC-DC converter as claimed in claim 1, wherein the temperature signal generated by the temperature detection circuit comprises a first temperature signal of positive temperature characteristics and a second temperature signal of negative temperature characteristics.

8. The DC-DC converter as claimed in claim 1, wherein the DC output voltage generated by the DC-DC converter is adapted to be fed to a liquid crystal display to serve as a working voltage of the liquid crystal display.

9. The DC-DC converter as claimed in claim 8, wherein the DC output voltage generated by the DC-DC converter is fed to the liquid crystal display to serve as a data driving voltage of a data driver circuit of the liquid crystal display.

10. The DC-DC converter as claimed in claim 8, wherein the DC output voltage generated by the DC-DC converter is fed to the liquid crystal display to serve as a gate switching-on voltage of a gate driver circuit of the liquid crystal display.

11. The DC-DC converter as claimed in claim 1, wherein the voltage supply circuit loop comprises an inductor and a forward-connected diode, the DC input voltage being fed through the inductor and the diode to provide the DC output voltage by the diode, the drain of the transistor based switching unit being connected to a node between the inductor and the diode.

* * * * *